US009249810B2

(12) United States Patent
Gammack et al.

(10) Patent No.: US 9,249,810 B2
(45) Date of Patent: Feb. 2, 2016

(54) FAN

(75) Inventors: Peter David Gammack, Malmesbury (GB); Frederic Nicolas, Malmesbury (GB); Kevin John Simmonds, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 1023 days.

(21) Appl. No.: 12/230,613

(22) Filed: Sep. 2, 2008

(65) Prior Publication Data

US 2009/0060711 A1 Mar. 5, 2009

(30) Foreign Application Priority Data

| | | |
|---|---|---|
| Sep. 4, 2007 | (GB) | 0717148.1 |
| Sep. 4, 2007 | (GB) | 0717151.5 |
| Sep. 4, 2007 | (GB) | 0717154.9 |
| Sep. 4, 2007 | (GB) | 0717155.6 |
| Aug. 14, 2008 | (GB) | 0814866.0 |

(51) Int. Cl.

| | |
|---|---|
| ***F04F 5/16*** | (2006.01) |
| ***F04F 5/46*** | (2006.01) |
| ***F04D 25/06*** | (2006.01) |
| ***F04D 25/08*** | (2006.01) |
| ***F04D 29/68*** | (2006.01) |

(52) U.S. Cl.

CPC . *F04F 5/46* (2013.01); *F04D 25/06* (2013.01); *F04D 25/08* (2013.01); *F04D 29/681* (2013.01); *F04F 5/16* (2013.01)

(58) Field of Classification Search

CPC ..... F04D 25/08; F04D 13/06; F04F 5/16; F04F 5/461; B05B 9/01

USPC ..... 239/265.17, 434.5, 561, 568, DIG. 7; 417/76, 84, 155, 177, 198, 79, 179

See application file for complete search history.

(56) References Cited

U.S. PATENT DOCUMENTS

| | | | |
|---|---|---|---|
| 1,357,261 | A | 11/1920 | Svoboda |
| 1,767,060 | A | 6/1930 | Ferguson |
| 1,896,869 | A | 2/1933 | Larsh |

(Continued)

FOREIGN PATENT DOCUMENTS

| | | |
|---|---|---|
| BE | 560119 | 8/1957 |
| CH | 346643 | 5/1960 |

(Continued)

OTHER PUBLICATIONS

Dyson, J., et al, "FAN" Design U.S. Appl. No. 29/336,687, filed May 7, 2009; 6 pages.

(Continued)

*Primary Examiner* — Bryan Lettman

(74) *Attorney, Agent, or Firm* — Morrison & Foerster LLP

(57) ABSTRACT

A bladeless fan assembly includes a nozzle mounted on a base housing a device creating an air flow through the nozzle. The nozzle includes an interior passage receiving the air flow from the base and a mouth through which the air flow is emitted. The nozzle extends substantially orthogonally about an axis to define an opening through which air from outside the fan assembly is drawn by the air flow emitted from the mouth. The depth of the base in the direction of the axis may be no more than twice the depth of the nozzle. The assembly produces an air current without requiring a bladed fan, that is, the air flow is created by a bladeless fan.

34 Claims, 5 Drawing Sheets

(56) References Cited

U.S. PATENT DOCUMENTS 2,014,185 A 9/1935 Marlin
2,035,733 A 3/1936 Wall
D103,476 S 3/1937 Weber
2,115,883 A 5/1938 Sher
D115,344 S 6/1939 Chapman
2,183,979 A * 12/1939 Tornberg ..... 416/100
2,210,458 A 8/1940 Keilholtz
2,258,961 A 10/1941 Saathoff
2,336,295 A 12/1943 Reimuller
2,433,795 A 12/1947 Stokes
2,473,325 A * 6/1949 Aufiero ..... 219/473
2,476,002 A 7/1949 Stalker
2,488,467 A * 11/1949 De Lisio ..... 239/561
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,073,613 A 2/1978 Desty
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,643,351 A 2/1987 Fukamachi et al.
4,703,152 A 10/1987 Shih-Chin
4,718,870 A 1/1988 Watts
4,732,539 A * 3/1988 Shin-Chin ..... 416/100
4,790,133 A 12/1988 Stuart
4,850,804 A 7/1989 Huang
4,878,620 A 11/1989 Tarleton
5,061,405 A 10/1991 Stanek et al.
D325,435 S 4/1992 Coup et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,425,902 A 6/1995 Miller et al.
5,518,370 A 5/1996 Wang et al.
5,609,473 A 3/1997 Litvin
5,645,769 A 7/1997 Tamaru et al.
5,649,370 A 7/1997 Russo
5,735,683 A 4/1998 Muschelknautz
5,762,034 A 6/1998 Foss
5,762,661 A 6/1998 Kleinberger et al.
D398,983 S 9/1998 Keller et al.
5,843,344 A 12/1998 Junket et al.
5,862,037 A 1/1999 Behl
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
D485,895 S 1/2004 Melwani
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
D598,532 S 8/2009 Dyson et al.
D602,143 S 10/2009 Gammack et al.
D602,144 S 10/2009 Dyson et al.
D605,748 S 12/2009 Gammack et al.
7,664,377 B2 * 2/2010 Liao ..... 388/851
D614,280 S 4/2010 Dyson et al.
7,775,848 B1 8/2010 Auerbach
7,806,388 B2 10/2010 Junkel et al.
8,092,166 B2 1/2012 Nicolas et al.
2002/0106547 A1 8/2002 Sugawara et al.
2003/0059307 A1 3/2003 Moreno et al.
2003/0171093 A1 9/2003 Gumucio Del Pozo
2004/0022631 A1 2/2004 Birdsell et al.
2004/0049842 A1 3/2004 Prehodka
2004/0149881 A1 8/2004 Allen
2005/0031448 A1 2/2005 Lasko et al.
2005/0053465 A1 3/2005 Roach et al.
2005/0069407 A1 3/2005 Winkler et al.
2005/0128698 A1 6/2005 Huang
2005/0163670 A1 7/2005 Alleyne et al.
2005/0173997 A1 8/2005 Schmid et al.
2006/0199515 A1 9/2006 Lasko et al.
2007/0065280 A1 3/2007 Fok
2007/0166160 A1 7/2007 Russak et al.
2007/0269323 A1 * 11/2007 Zhou et al. ..... 417/423.7
2008/0152482 A1 6/2008 Patel
2008/0166224 A1 7/2008 Giffin
2008/0286130 A1 11/2008 Purvines
2009/0026850 A1 1/2009 Fu
2009/0039805 A1 2/2009 Tang
2009/0060710 A1 3/2009 Gammack et al.
2009/0191054 A1 7/2009 Winkler
2009/0214341 A1 8/2009 Craig
2010/0150699 A1 6/2010 Nicolas et al.
2010/0162011 A1 6/2010 Min
2010/0171465 A1 7/2010 Seal et al.
2010/0225012 A1 9/2010 Fitton et al.
2010/0226749 A1 9/2010 Gammack et al.
2010/0226750 A1 9/2010 Gammack
2010/0226751 A1 9/2010 Gammack et al.
2010/0226752 A1 9/2010 Gammack et al.
2010/0226753 A1 9/2010 Dyson et al.
2010/0226754 A1 9/2010 Hutton et al.
2010/0226758 A1 9/2010 Cookson et al.
2010/0226763 A1 9/2010 Gammack et al.
2010/0226764 A1 9/2010 Gammack et al.
2010/0226769 A1 9/2010 Helps
2010/0226771 A1 9/2010 Crawford et al.
2010/0226787 A1 9/2010 Gammack et al.
2010/0226797 A1 9/2010 Fitton et al.
2010/0226801 A1 9/2010 Gammack
2010/0254800 A1 10/2010 Fitton et al.
2011/0164959 A1 7/2011 Fitton et al.
2011/0223014 A1 9/2011 Crawford et al.
2011/0223015 A1 9/2011 Gammack et al.
2012/0031509 A1 2/2012 Wallace et al.
2012/0033952 A1 2/2012 Wallace et al.
2012/0034108 A1 2/2012 Wallace et al.
2012/0039705 A1 2/2012 Gammack
2012/0045315 A1 2/2012 Gammack

(56) References Cited

U.S. PATENT DOCUMENTS

| | | | |
|---|---|---|---|
| 2012/0045316 | A1 | 2/2012 | Gammack |
| 2012/0057959 | A1 | 3/2012 | Hodgson et al. |
| 2012/0082561 | A1 | 4/2012 | Gammack et al. |

FOREIGN PATENT DOCUMENTS

| | | | | |
|---|---|---|---|---|
| CN | 2111392 | | 7/1992 | |
| CN | 1437300 | | 8/2003 | |
| CN | 2833197 | | 11/2006 | |
| CN | 201221477 | | 4/2009 | |
| CN | 201349269 | | 11/2009 | |
| CN | 101749288 | | 6/2010 | |
| CN | 201502549 | | 6/2010 | |
| CN | 101984299 | | 3/2011 | |
| CN | 201802648 | | 4/2011 | |
| DE | 1 291 090 | | 3/1969 | |
| DE | 24 51 557 | | 5/1976 | |
| DE | 27 48 724 | | 5/1978 | |
| DE | 3644567 | | 7/1988 | |
| DE | 19510397 | | 9/1996 | |
| DE | 197 12 228 | | 10/1998 | |
| DE | 10 2009 007 037 | | 8/2010 | |
| EP | 1 138 954 | | 10/2001 | |
| EP | 1 779 745 | | 5/2007 | |
| EP | 1 939 456 | | 7/2008 | |
| EP | 1 980 432 | | 10/2008 | |
| EP | 2 000 675 | | 12/2008 | |
| FR | 1033034 | | 7/1953 | |
| FR | 1119439 | | 6/1956 | |
| FR | 1387334 | | 1/1965 | |
| FR | 2 640 857 | | 6/1990 | |
| FR | 2 658 593 | | 8/1991 | |
| FR | 2794195 | | 12/2000 | |
| FR | 2 906 980 | | 4/2008 | |
| GB | 22235 | | 6/1914 | |
| GB | 383498 | | 11/1932 | |
| GB | 593828 | | 10/1947 | |
| GB | 601222 | | 4/1948 | |
| GB | 633273 | | 12/1949 | |
| GB | 641622 | | 8/1950 | |
| GB | 661747 | | 11/1951 | |
| GB | 863 124 | | 3/1961 | |
| GB | 1067956 | | 5/1967 | |
| GB | 1262131 | | 2/1972 | |
| GB | 1265341 | | 3/1972 | |
| GB | 1 278 606 | | 6/1972 | |
| GB | 1 304 560 | | 1/1973 | |
| GB | 1 403 188 | | 8/1975 | |
| GB | 1 434 226 | | 5/1976 | |
| GB | 1501473 | | 2/1978 | |
| GB | 2 094 400 | | 9/1982 | |
| GB | 2 107 787 | | 5/1983 | |
| GB | 2 111 125 | | 6/1983 | |
| GB | 2 178 256 | | 2/1987 | |
| GB | 2 185 533 | | 7/1987 | |
| GB | 2185531 | | 7/1987 | |
| GB | 2 218 196 | | 11/1989 | |
| GB | 2236804 | | 4/1991 | |
| GB | 2 240 268 | | 7/1991 | |
| GB | 2242935 | | 10/1991 | |
| GB | 2 285 504 | | 7/1995 | |
| GB | 2 289 087 | | 11/1995 | |
| GB | 2 428 569 | | 2/2007 | |
| GB | 2 452 593 | | 3/2009 | |
| GB | 2452490 | | 3/2009 | |
| GB | 2463698 | | 3/2010 | |
| GB | 2464736 | | 4/2010 | |
| GB | 2466058 | | 6/2010 | |
| GB | 2468369 | | 8/2010 | |
| GB | 2468312 | | 9/2010 | |
| GB | 2468313 | | 9/2010 | |
| GB | 2468319 | | 9/2010 | |
| GB | 2468320 | | 9/2010 | |
| GB | 2468328 | | 9/2010 | |
| GB | 2468331 | | 9/2010 | |
| JP | 51-7258 | | 1/1976 | |
| JP | 56-167897 | | 12/1981 | |
| JP | 57-157097 | | 9/1982 | |
| JP | 61-31830 | | 2/1986 | |
| JP | 61-116093 | | 6/1986 | |
| JP | 63-179198 | | 7/1988 | |
| JP | 64-21300 | U | 2/1989 | |
| JP | 64-83884 | | 3/1989 | |
| JP | 1-138399 | | 5/1989 | |
| JP | 1-224598 | | 9/1989 | |
| JP | 2-218890 | | 8/1990 | |
| JP | 2-248690 | | 10/1990 | |
| JP | 4-43895 | | 2/1992 | |
| JP | S64-21300 | * | 2/1992 | ..... F04F 5/16 |
| JP | 4-366330 | | 12/1992 | |
| JP | 5-157093 | | 6/1993 | |
| JP | 5-263786 | | 10/1993 | |
| JP | 6-74190 | | 3/1994 | |
| JP | 6-147188 | | 5/1994 | |
| JP | 6-257591 | | 9/1994 | |
| JP | 7-190443 | | 7/1995 | |
| JP | 9-100800 | | 4/1997 | |
| JP | 11-227866 | | 8/1999 | |
| JP | 2000-116179 | | 4/2000 | |
| JP | 2000-201723 | | 7/2000 | |
| JP | 2001-17358 | | 1/2001 | |
| JP | 2002-21797 | | 1/2002 | |
| JP | 2004-208935 | | 7/2004 | |
| JP | 2004-216221 | | 8/2004 | |
| JP | 2005-307985 | | 11/2005 | |
| JP | 2006-89096 | | 4/2006 | |
| JP | 3127331 | | 11/2006 | |
| JP | 2007-138763 | | 6/2007 | |
| JP | 2007-138789 | | 6/2007 | |
| JP | 2008-100204 | | 5/2008 | |
| JP | 2009-44568 | | 2/2009 | |
| JP | 2010-131259 | | 6/2010 | |
| KR | 10-2010-0055611 | | 5/2010 | |
| KR | 10-0985378 | | 9/2010 | |
| WO | WO 90/13478 | | 11/1990 | |
| WO | WO-02/073096 | | 9/2002 | |
| WO | WO 03/058795 | | 7/2003 | |
| WO | WO-03/069931 | | 8/2003 | |
| WO | WO-2005/050026 | | 6/2005 | |
| WO | WO 2005/057091 | | 6/2005 | |
| WO | WO 2007/024955 | | 3/2007 | |
| WO | WO 2007/048205 | | 5/2007 | |
| WO | WO 2008/014641 | | 2/2008 | |
| WO | WO-2008/024569 | | 2/2008 | |
| WO | WO-2009/030879 | | 3/2009 | |
| WO | WO-2009/030881 | | 3/2009 | |
| WO | WO-2010/100452 | | 9/2010 | |
| WO | WO-2010/100453 | | 9/2010 | |

OTHER PUBLICATIONS

Reba, I., (Jun. 1966). "Applications of the Coanda Effect." *Scientific American*.214:84-92.

GB Search Report directed at counterpart application GB0717151.5 mailed on Dec. 17, 2007; 2 pages.

GB Search Report directed at counterpart application GB0717155.6 mailed on Dec. 19, 2007; 2 pages.

GB Search Report directed at counterpart application GB0717154.9 mailed on Dec. 17, 2007; 2 pages.

GB Search Report directed at counterpart application GB0717148.1 mailed on Dec. 20, 2007; 2 pages.

International Search Report and Written Opinion mailed Oct. 31, 2008, directed to counterpart International Patent Application No. PCT/GB2008/002874; (9 pages).

Gammack at al., U.S. Office Action mailed Jun. 15, 2009, directed to Design U.S. Appl. No. 29/328,939; (5 pages).

International Search Report and Written Opinion mailed on Oct. 29, 2008, directed to International Patent Application No. PCT/GB2008/002891; 11 pages.

Gammack et al., U.S. Office Action mailed Dec. 9, 2010, directed to related U.S. Appl. No. 12/203,698; 10 pages.

(56) References Cited

OTHER PUBLICATIONS

Gammack et al., U.S. Appl. No. 12/917,247, filed Nov. 1, 2010; 40 pages.
Fitton et al., U.S. Office Action mailed Nov. 30, 2010 directed to U.S. Appl. No. 12/560,232; 9 pages.
Gammack, P. et al., U.S. Office Action mailed Dec. 9, 2010, directed to U.S. Appl. No. 12/716,781; 17 pages.
Simmonds, K. J. et al. U.S. Appl. No. 13/125,742, filed Apr. 22, 2011; 20 pages.
Nicolas, F. et al., U.S. Office Action mailed Mar. 7, 2011, directed to U.S. Appl. No. 12/622,844; 10 pages.
Fitton, N.G. et al., U.S. Office Action mailed Mar. 8, 2011, directed to U.S. Appl. No. 12/716,780; 12 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed May 24, 2011, directed to U.S. Appl. No. 12/716,613; 9 pages.
Third Party Submission Under 37 C.F.R. 1.99 filed Jun. 2, 2011, directed to U.S. Appl. No. 12/203,698; 3 pages.
Gammack, P. et al., U.S. Office Action mailed Jun. 21, 2011, directed to U.S. Appl. No. 12/203,698; 11 pages.
Gammack, P. et al., U.S. Office Action mailed Jun. 24, 2011, directed to U.S. Appl. No. 12/716,781; 19 pages.
Nicolas, F. et al., U.S. Office Action mailed Sep. 8, 2011, directed to U.S. Appl. No. 12/622,844; 11 pages.
Fitton, et al., U.S. Office Action mailed Sep. 6, 2011, directed to U.S. Appl. No. 12/716,780; 16 pages.
Fitton et al., U.S. Office Action mailed Mar. 30, 2012, directed to U.S. Appl. No. 12/716,707; 7 pages.

* cited by examiner

FAN

REFERENCE TO RELATED APPLICATIONS

This application claims the priority of United Kingdom Application Nos. 0717155.6, 0717148.1, 0717151.5 and 0717154.9, all filed Sep. 4, 2007, and No. 0814866.0, filed Aug. 14, 2008, the contents of which prior applications are incorporated herein by reference.

FIELD OF THE INVENTION

The present invention relates to a fan appliance. Particularly, but not exclusively, the present invention relates to a domestic fan, such as a desk fan, for creating air circulation and air current in a room, in an office or other domestic environment.

BACKGROUND OF THE INVENTION

A number of types of domestic fan are known. It is common for a conventional fan to include a single set of blades or vanes mounted for rotation about an axis, and driving apparatus mounted about the axis for rotating the set of blades. Domestic fans are available in a variety of sizes and diameters, for example, a ceiling fan can be at least 1 m in diameter and is usually mounted in a suspended manner from the ceiling and positioned to provide a downward flow of air and cooling throughout a room.

Desk fans, on the other hand, are often around 30 cm in diameter and are usually free standing and portable. In standard desk fan arrangements the single set of blades is positioned close to the user and the rotation of the fan blades provides a forward flow of air current in a room or into a part of a room, and towards the user. Other types of fan can be attached to the floor or mounted on a wall. The movement and circulation of the air creates a so called 'wind chill' or breeze and, as a result, the user experiences a cooling effect as heat is dissipated through convection and evaporation. Fans such as that disclosed in U.S. D 103,476 and U.S. Pat. No. 1,767,060 are suitable for standing on a desk or a table. U.S. Pat. No. 1,767,060 describes a desk fan with an oscillating function that aims to provide an air circulation equivalent to two or more prior art fans.

A disadvantage of this type of arrangement is that the forward flow of air current produced by the rotating blades of the fan is not felt uniformly by the user. This is due to variations across the blade surface or across the outward facing surface of the fan. Uneven or 'choppy' air flow can be felt as a series of pulses or blasts of air and can be noisy. A further disadvantage is that the cooling effect created by the fan diminishes with distance from the user. This means that the fan must be placed in close proximity to the user in order for the user to receive the benefit of the fan.

In a domestic environment it is desirable for appliances to be as small and compact as possible due to space restrictions. It is undesirable for parts to project from the appliance, or for the user to be able to touch any moving parts of the fan, such as the blades. Some arrangements have safety features such as a cage or shroud around the blades to protect a user from injuring himself on the moving parts of the fan. U.S. D 103,476 shows a type of cage around the blades however, caged blade parts can be difficult to clean.

Other types of fan or circulator are described in U.S. Pat. No. 2,488,467, U.S. Pat. No. 2,433,795 and JP 56-167897. The fan of U.S. Pat. No. 2,433,795 has spiral slots in a rotating shroud instead of fan blades. The circulator fan disclosed in U.S. Pat. No. 2,488,467 emits air flow from a series of nozzles and has a large base including a motor and a blower or fan for creating the air flow.

Locating fans such as those described above close to a user is not always possible as the bulky shape and structure mean that the fan occupies a significant amount of the user's work space area. In the particular case of a fan placed on, or close to, a desk the fan body or base reduces the area available for paperwork, a computer or other office equipment. Often multiple appliances must be located in the same area, close to a power supply point, and in close proximity to other appliances for ease of connection and in order to reduce the operating costs.

The shape and structure of a fan at a desk not only reduces the working area available to a user but can block natural light (or light from artificial sources) from reaching the desk area. A well lit desk area is desirable for close work and for reading. In addition, a well lit area can reduce eye strain and the related health problems that may result from prolonged periods working in reduced light levels.

SUMMARY OF THE INVENTION

The present invention seeks to provide an improved fan assembly which obviates disadvantages of the prior art. It is an object of the present invention to provide a compact fan assembly which, in use, generates air flow at an even rate over the emission output area of the fan.

According to a first aspect of the invention, there is provided a bladeless fan assembly for creating an air current, the fan assembly comprising a nozzle mounted on a base housing means for creating an air flow through the nozzle, the nozzle comprising an interior passage for receiving the air flow from the base and a mouth through which the air flow is emitted, the nozzle extending substantially orthogonally about an axis to define an opening through which air from outside the fan assembly is drawn by the air flow emitted from the mouth, wherein the nozzle and the base each have a depth in the direction of the axis, and wherein the depth of the base is no more than twice the depth of the nozzle.

Preferably the depth of the base is in the range of 100 mm to 200 mm, more preferably around 150 mm. In this arrangement it is preferred that the fan assembly has a height extending from the end of the base remote from the nozzle to the end of the nozzle remote from the base, and a width perpendicular to the height, both the height and the width being perpendicular to the said axis, and wherein the width of the base is no more than 75% the width of the nozzle.

According to a second aspect of the present invention, there is also provided a bladeless fan assembly for creating an air current, the fan assembly comprising a nozzle mounted on a base housing means for creating an air flow through the nozzle, the nozzle comprising an interior passage for receiving the air flow from the base and a mouth through which the air flow is emitted, the nozzle extending substantially orthogonally about an axis to define an opening through which air from outside the fan assembly is drawn by the air flow emitted from the mouth, the fan assembly having a height extending from the end of the base remote from the nozzle to the end of the nozzle remote from the base, and a width perpendicular to the height, both the height and the width being perpendicular to the axis, and wherein the width of the base is no more than 75% the width of the nozzle.

Both aspects of the invention provide arrangements in which an air current is generated and a cooling effect is created without requiring a bladed fan. The bladeless arrangement leads to lower noise emissions due to the absence of the sound of a fan blade moving through the air, and a reduction in moving parts and complexity. The dimensions of the base are small compared to those of the nozzle and compared to the size of the overall fan assembly structure. The depth of the base of the fan assembly is such that the fan assembly is a slim product, occupying little of a user's work space area. Advantageously the invention provides a fan assembly delivering a suitable cooling effect from a footprint smaller than that of prior art fans. Advantageously, by this arrangement the assembly can be produced and manufactured with a reduced number of parts than those required in prior art fans. This reduces manufacturing cost and complexity.

In the following description of fans and, in particular a fan of the preferred embodiment, the term 'bladeless' is used to describe apparatus in which air flow is emitted or projected forwards from the fan assembly without the use of blades. By this definition a bladeless fan assembly can be considered to have an output area or emission zone absent blades or vanes from which the air flow is released or emitted in a direction appropriate for the user. A bladeless fan assembly may be supplied with a primary source of air from a variety of sources or generating means such as pumps, generators, motors or other fluid transfer devices, which include rotating devices such as a motor rotor and a bladed impeller for generating air flow. The supply of air generated by the motor causes a flow of air to pass from the room space or environment outside the fan assembly through the interior passage to the nozzle and then out through the mouth.

Hence, the description of a fan assembly as bladeless is not intended to extend to the description of the power source and components such as motors that are required for secondary fan functions. Examples of secondary fan functions can include lighting, adjustment and oscillation of the fan.

Preferably, the width of the base of the fan assembly is in the range from 65% to 55% the width of the nozzle, more preferably around 50% the width of the nozzle. In a preferred embodiment the height of the fan assembly is in the range 300 mm to 400 mm, more preferably around 350 mm. The preferred features and dimensions of the fan assembly result in a compact arrangement while generating a suitable amount of air flow from the fan assembly for cooling a user.

It is preferred that the base is substantially cylindrical. This arrangement creates a fan assembly with a compact base that appears tidy and uniform. This type of uncluttered design is desirable and often appeals to a user or customer. In addition, when placed on a desk or work surface the area of the desk surface occupied by the base of the fan assembly is less than the space occupied by other known fan assemblies. The nozzle occupies space above the desk surface, extending away from the base without obscuring the desk surface or impeding the user's access to the surface of the desk.

Preferably the base has at least one air inlet arranged substantially orthogonal to the axis. Preferably the base has a side wall comprising said at least one air inlet. Locating air inlets around the base provides flexibility in the arrangement of the base and the nozzle, and enables air to flow into the base from a variety of points thereby to enable more air to flow into the assembly as a whole. More preferably, said at least one air inlet comprises a plurality of air inlets extending about a second axis substantially orthogonal to said first-mentioned axis. In this arrangement it is preferred that the assembly has a flow path extending from each air inlet to an inlet to the means for creating an air flow through the nozzle, wherein the inlet to the means for creating an air flow is substantially orthogonal to the or each air inlet. The arrangement provides an inlet air path that minimises noise and frictional losses in the system.

In either of the aforementioned aspects, the nozzle may comprise a Coanda surface located adjacent the mouth and over which the mouth is arranged to direct the air flow. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment whereby a primary air flow is directed over the Coanda surface. A description of the features of a Coanda surface, and the effect of fluid flow over a Coanda surface, can be found in articles such as Reba, Scientific American, Volume 214, June 1963 pages 84 to 92. Through use of a Coanda surface, air from outside the fan assembly is drawn through the opening by the air flow directed over the Coanda surface.

In the present invention an air flow is created through the nozzle of the fan assembly. In the following description this air flow will be referred to as primary air flow. The primary air flow exits the nozzle via the mouth and preferably passes over the Coanda surface. The primary air flow entrains the air surrounding the mouth of the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly. The primary air flow directed over the Coanda surface combined with the secondary air flow entrained by the air amplifier gives a total air flow emitted or projected forward to a user from the opening defined by the nozzle. The total air flow is sufficient for the fan assembly to create an air current suitable for cooling.

The air current delivered by the fan assembly to the user has the benefit of being an air flow with low turbulence and with a more linear air flow profile than that provided by other prior art devices. Linear air flow with low turbulence travels efficiently out from the point of emission and loses less energy and less velocity to turbulence than the air flow generated by prior art fans. An advantage for a user is that the cooling effect can be felt even at a distance and the overall efficiency of the fan increases. This means that the user can choose to site the fan some distance from a work area or desk and still be able to feel the cooling benefit of the fan.

Advantageously, the assembly results in the entrainment of air surrounding the mouth of the nozzle such that the primary air flow is amplified by at least 15%, whilst a smooth overall output is maintained. The entrainment and amplification features of the fan assembly result in a fan with a higher efficiency than prior art devices. The air current emitted from the opening defined by the nozzle has an approximately flat velocity profile across the diameter of the nozzle. Overall the flow rate and profile can be described as plug flow with some regions having a laminar or partial laminar flow.

Preferably the nozzle comprises a loop. The shape of the nozzle is not constrained by the requirement to include space for a bladed fan. In a preferred embodiment the nozzle is annular. By providing an annular nozzle the fan can potentially reach a broad area. In a further preferred embodiment the nozzle is at least partially circular. This arrangement can provide a variety of design options for the fan, increasing the choice available to a user or customer.

Preferably, the interior passage is continuous, more preferably substantially annular. This allows smooth, unimpeded air flow within the nozzle and reduces frictional losses and noise. In this arrangement the nozzle can be manufactured as a single piece, reducing the complexity of the fan assembly and thereby reducing manufacturing costs.

In the preferred fan arrangement the means for creating an air flow through the nozzle is arranged to create an air flow through the nozzle having a pressure of at least 400 kPa. This pressure is sufficient to overcome the pressure created by the constriction caused by the mouth of the nozzle and provides pressure for an output air flow suitable for cooling a user. More preferably, in use, the mass flow rate of air projected from the fan assembly is at least 450 l/s, most preferably in the range from 600 l/s to 700 l/s. Advantageously this mass flow rate can be projected forward from the opening and the area surrounding the mouth of the nozzle with a laminar flow and can be experienced by the user as a superior cooling effect to that from a bladed fan.

In the preferred fan arrangement the means for creating an air flow through the nozzle comprises an impeller driven by a motor. This arrangement provides a fan with efficient air flow generation. More preferably the means for creating an air flow comprises a DC brushless motor and a mixed flow impeller. This arrangement reduces frictional losses from motor brushes and also reduces carbon debris from the brushes in a traditional motor. Reducing carbon debris and emissions is advantageous in a clean or pollutant sensitive environment such as a hospital or around those with allergies.

The nozzle may be rotatable or pivotable relative to a base portion, or other portion, of the fan assembly. This enables the nozzle to be directed towards or away from a user as required. The fan assembly may be desk, floor, wall or ceiling mountable. This can increase the portion of a room over which the user experiences cooling.

The mouth may be substantially annular. By providing a substantially annular mouth the total air flow can be emitted towards a user over a broad area. Advantageously, an illumination source in the room or at the desk fan location or natural light can reach the user through the central opening. The mouth may be concentric with the interior passage. This arrangement will be visually appealing and the concentric location of the mouth with the passage facilitates manufacture.

BRIEF DESCRIPTION OF THE DRAWINGS

An embodiment of the invention will now be described with reference to the accompanying drawings, in which.

DETAILED DESCRIPTION OF THE INVENTION

Figure 1:
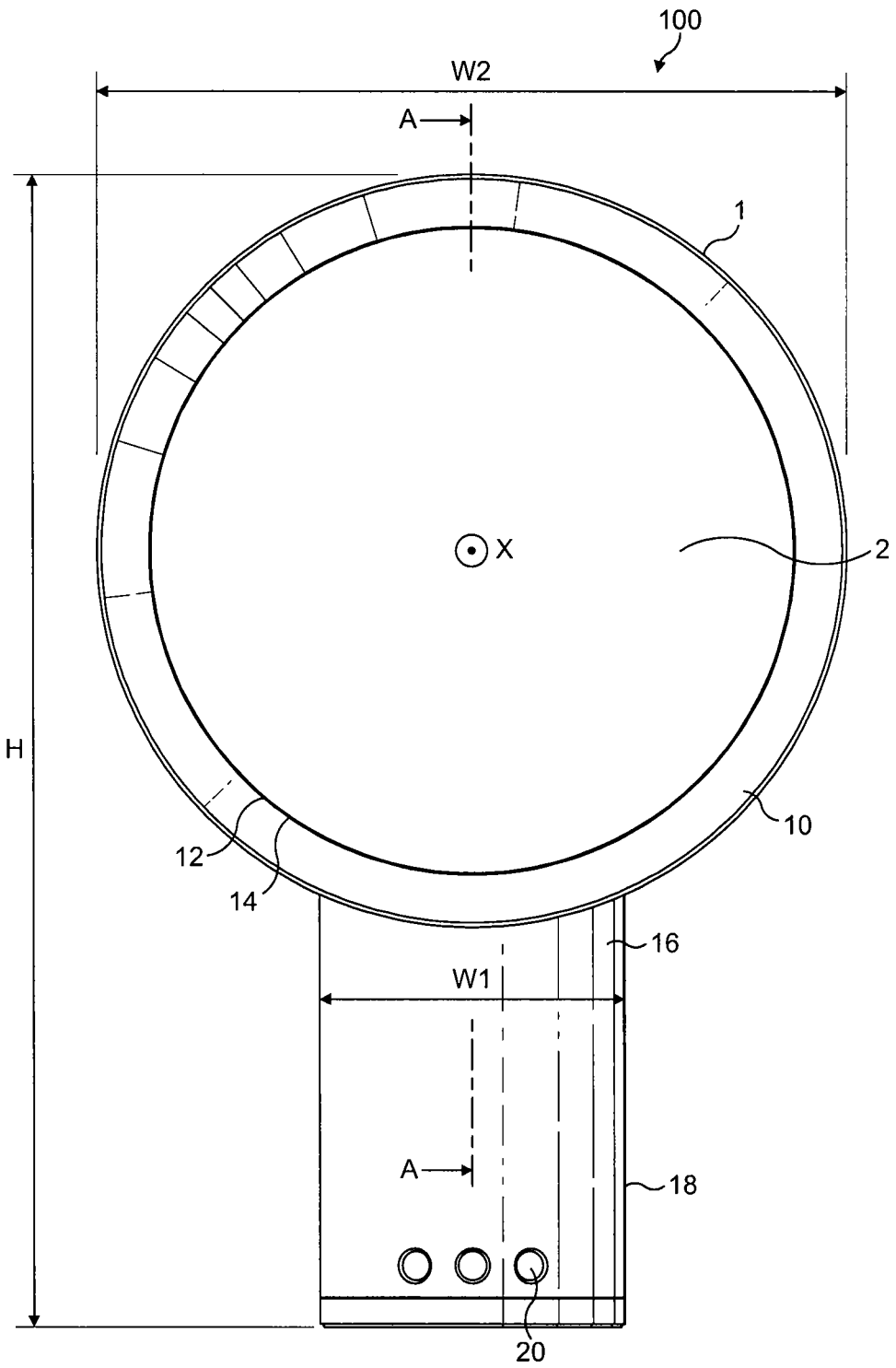
FIG. 1 is a front view of a fan assembly.
Figure 2:
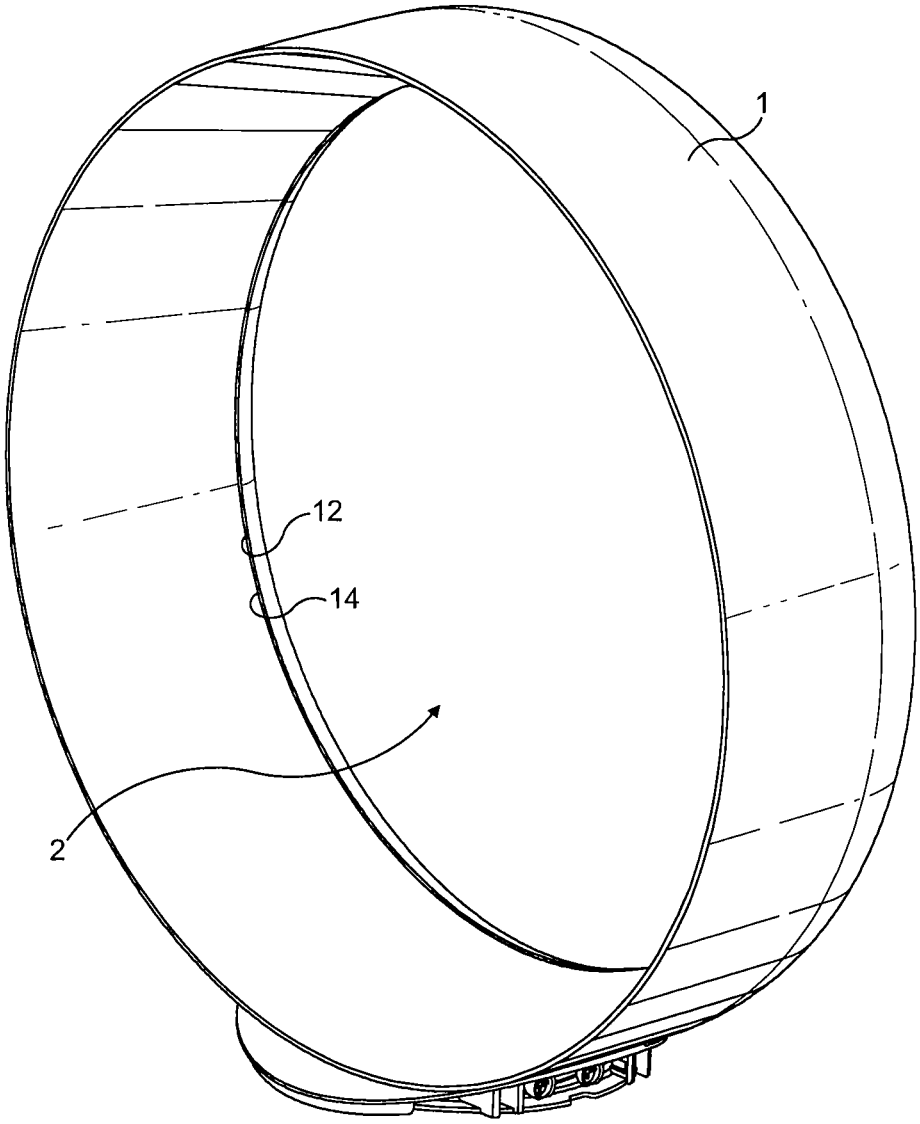
FIG. 2 is a perspective view of a portion of the fan assembly of FIG. 1.
Figure 3:
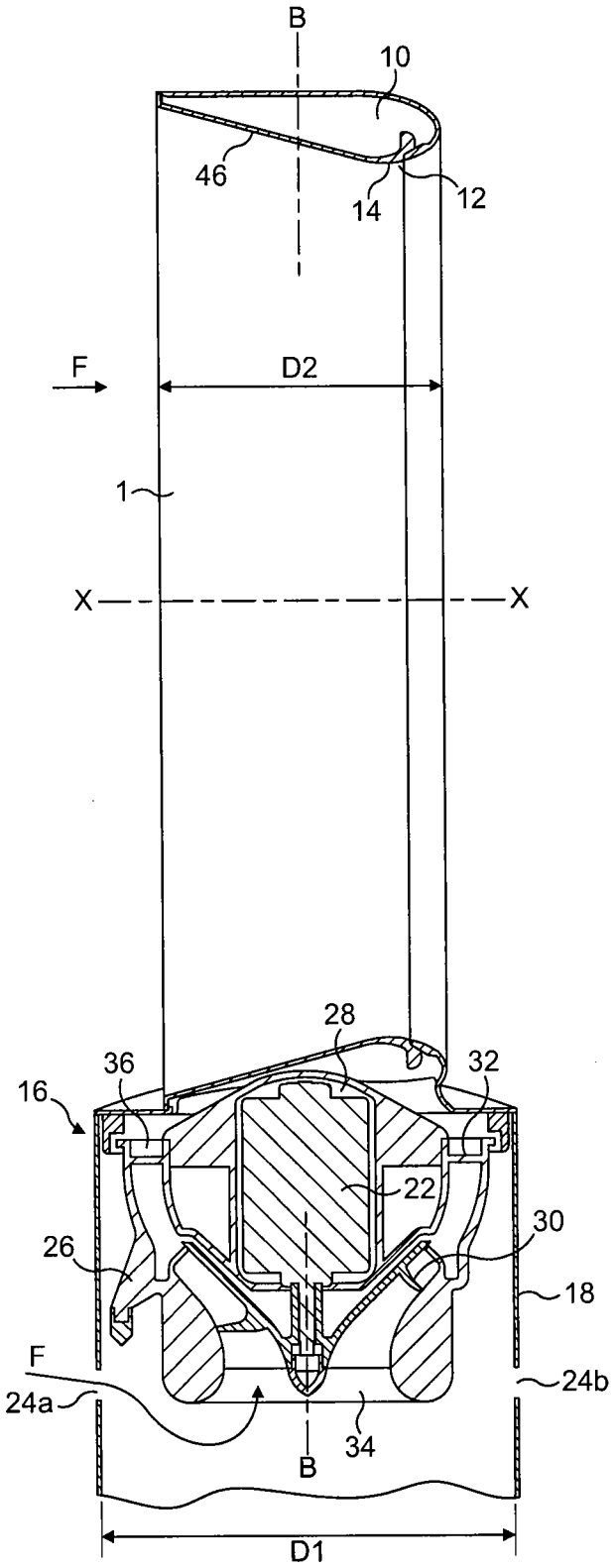
FIG. 3 is a side sectional view through a portion of the fan assembly of FIG. 1 taken at line A-A.

FIG. 1 shows an example of a fan assembly 100 viewed from the front of the device. The fan assembly 100 comprises an annular nozzle 1 defining a central opening 2. With reference also to FIGS. 2 and 3, nozzle 1 comprises an interior passage 10, a mouth 12 and a Coanda surface 14 adjacent the mouth 12. The Coanda surface 14 is arranged so that a primary air flow exiting the mouth 12 and directed over the Coanda surface 14 is amplified by the Coanda effect. The nozzle 1 is connected to, and supported by, a base 16 having an outer casing 18. The base 16 includes a plurality of selection buttons 20 accessible through the outer casing 18 and through which the fan assembly 100 can be operated. The fan assembly has a height, H, width, W, and depth, D, shown on FIGS. 1 and 3. The nozzle 1 is arranged to extend substantially orthogonally about the axis X. The height of the fan assembly, H, is perpendicular to the axis X and extends from the end of the base 16 remote from the nozzle 1 to the end of the nozzle 1 remote from the base 16. In this embodiment the fan assembly 100 has a height, H, of around 530 mm, but the fan assembly 100 may have any desired height, for example around 475 mm. The base 16 and the nozzle 1 have a width, W, perpendicular to the height H and perpendicular to the axis X. The width of the base 16 is shown labelled W1 and the width of the nozzle 1 is shown labelled as W2 on FIG. 1. The base 16 and the nozzle 1 have a depth in the direction of the axis X. The depth of the base 16 is shown labelled D1 and the depth of the nozzle 1 is shown labelled as D2 on FIG. 3.

Figure 4:
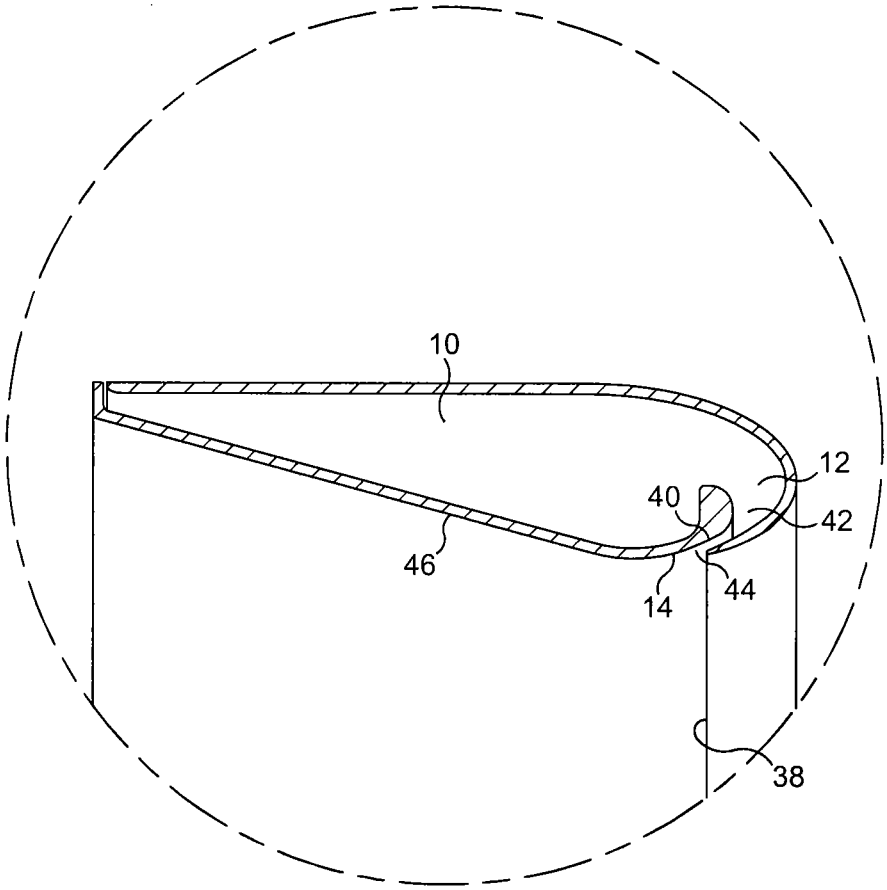
FIG. 4 is an enlarged side sectional detail of a portion of the fan assembly of FIG. 1.
Figure 5:
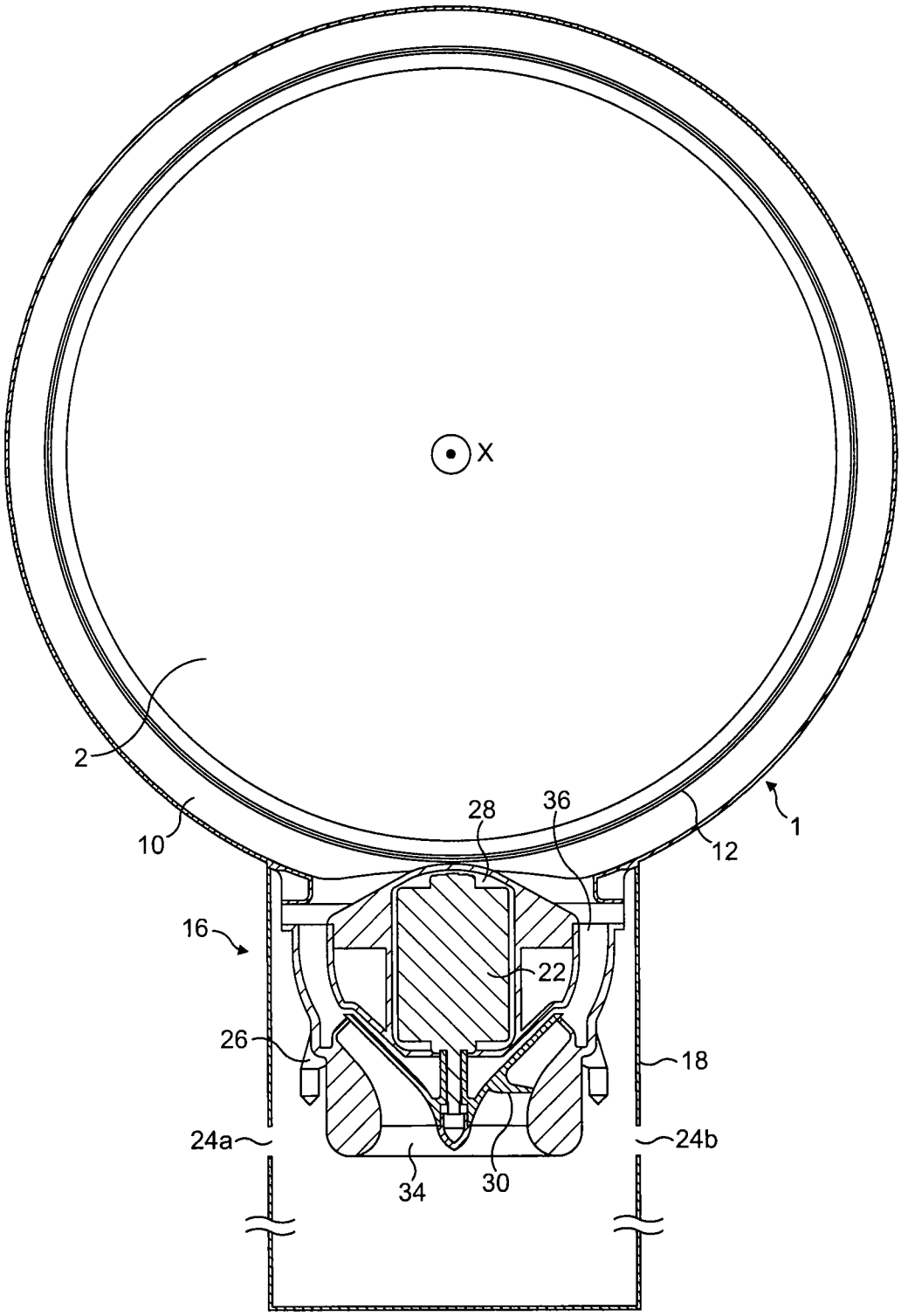
FIG. 5 is a sectional view of the fan assembly taken along line B-B of FIG. 3 and viewed from direction F of FIG. 3.

FIGS. 3, 4 and 5 show further specific details of the fan assembly 100. A motor 22 for creating an air flow through the nozzle 1 is located inside the base 16. The base 16 is substantially cylindrical and in this embodiment the base 16 has a diameter (that is, a width W1 and a depth D1) of around 145 mm. The base 16 further comprises air inlets 24*a*, 24*b* formed in the outer casing 18. A motor housing 26 is located inside the base 16. The motor 22 is supported by the motor housing 26 and held in a secure position by a rubber mount or seal member 28.

In the illustrated embodiment, the motor 22 is a DC brushless motor. An impeller 30 is connected to a rotary shaft extending outwardly from the motor 22, and a diffuser 32 is positioned downstream of the impeller 30. The diffuser 32 comprises a fixed, stationary disc having spiral blades.

An inlet 34 to the impeller 30 communicates with the air inlets 24*a*, 24*b* formed in the outer casing 18 of the base 16. The outlet 36 of the diffuser 32 and the exhaust from the impeller 30 communicate with hollow passageway portions or ducts located inside the base 16 in order to establish air flow from the impeller 30 to the interior passage 10 of the nozzle 1. The motor 22 is connected to an electrical connection and power supply and is controlled by a controller (not shown). Communication between the controller and the plurality of selection buttons 20 enable a user to operate the fan assembly 100.

The features of the nozzle 1 will now be described with reference to FIGS. 3 and 4. The shape of the nozzle 1 is annular. In this embodiment the nozzle 1 has a diameter of around 350 mm, but the nozzle may have any desired diameter, for example around 300 mm. The interior passage 10 is annular and is formed as a continuous loop or duct within the nozzle 1. The nozzle 1 is formed from at least one wall defining the interior passage 10 and the mouth 12. In this embodiment the nozzle 1 comprises an inner wall 38 and an outer wall 40. In the illustrated embodiment the walls 38, 40 are arranged in a looped or folded shape such that the inner wall 38 and outer wall 40 approach one another. The inner wall 38 and the outer wall 40 together define the mouth 12, and the mouth 12 extends about the axis X. The mouth 12 comprises a tapered region 42 narrowing to an outlet 44. The outlet 44 comprises a gap or spacing formed between the inner wall 38 of the nozzle 1 and the outer wall 40 of the nozzle 1. The spacing between the opposing surfaces of the walls 38, 40 at the outlet 44 of the mouth 12 is chosen to be in the range from 1 mm to 5 mm. The choice of spacing will depend on the desired performance characteristics of the fan. In this embodiment the outlet 44 is around 1.3 mm wide, and the mouth 12 and the outlet 44 are concentric with the interior passage 10.

The mouth 12 is adjacent the Coanda surface 14. The nozzle 1 of the illustrated embodiment further comprises a diffuser portion located downstream of the Coanda surface. The diffuser portion includes a diffuser surface 46 to further assist the flow of air current delivered or output from the fan assembly 100. In the example illustrated in FIG. 3 the mouth 12 and the overall arrangement of the nozzle 1 is such that the angle subtended between the Coanda surface 14 and the axis X is around 15°. The angle is chosen for efficient air flow over the Coanda surface 14. The nozzle 1 extends by a distance of around 5 cm in the direction of the axis. The diffuser surface 46 and the overall profile of the nozzle 1 are based on an aerofoil shape, and in the example shown the diffuser portion extends by a distance of around two thirds the overall depth of the nozzle 1.

The fan assembly 100 described above operates in the following manner. When a user makes a suitable selection from the plurality of buttons 20 to operate or activate the fan assembly 100, a signal or other communication is sent to drive the motor 22. The motor 22 is thus activated and air is drawn into the fan assembly 100 via the air inlet 24. In the preferred embodiment air is drawn in at a rate of approximately 20 to 30 liters per second, preferably around 27 l/s (liters per second). The air passes through the outer casing 18 and along the route illustrated by arrow F of FIG. 3 to the inlet 34 of the impeller 30. The air flow leaving the outlet 36 of the diffuser 32 and the exhaust of the impeller 30 is divided into two air flows that proceed in opposite directions through the interior passage 10. The air flow is constricted as it enters the mouth 12 and is further constricted at the outlet 44 of the mouth 12. The constriction creates pressure in the system. The motor 22 creates an air flow through the nozzle 16 having a pressure of at least 400 kPa. The air flow created overcomes the pressure created by the constriction and the air flow exits through the outlet 44 as a primary air flow.

The output and emission of the primary air flow creates a low pressure area at the air inlets 24*a*, 24*b* with the effect of drawing additional air into the fan assembly 100. The operation of the fan assembly 100 induces high air flow through the nozzle 1 and out through the opening 2. The primary air flow is directed over the Coanda surface 14 and the diffuser surface 46, and is amplified by the Coanda effect. A secondary air flow is generated by entrainment of air from the external environment, specifically from the region around the outlet 44 and from around the outer edge of the nozzle 1. A portion of the secondary air flow entrained by the primary air flow may also be guided over the diffuser surface 46. This secondary air flow passes through the opening 2, where it combines with the primary air flow to produce a total air flow projected forward from the nozzle 1.

The combination of entrainment and amplification results in a total air flow from the opening 2 of the fan assembly 100 that is greater than the air flow output from a fan assembly without such a Coanda or amplification surface adjacent the emission area.

The amplification and laminar type of air flow produced results in a sustained flow of air being directed towards a user from the nozzle 1. In the preferred embodiment the mass flow rate of air projected from the fan assembly 100 is at least 450 l/s, preferably in the range from 600 l/s to 700 l/s. The flow rate at a distance of up to 3 nozzle diameters (i.e. around 1000 to 1200 mm) from a user is around 400 to 500 l/s. The total air flow has a velocity of around 3 to 4 m/s (meters per second). Higher velocities are achievable by reducing the angle subtended between the Coanda surface 14 and the axis X. A smaller angle results in the total air flow being emitted in a more focussed and directed manner. This type of air flow tends to be emitted at a higher velocity but with a reduced mass flow rate. Conversely, greater mass flow can be achieved by increasing the angle between the Coanda surface and the axis. In this case the velocity of the emitted air flow is reduced but the mass flow generated increases. Thus the performance of the fan assembly can be altered by altering the angle subtended between the Coanda surface and the axis X.

The invention is not limited to the detailed description given above. Variations will be apparent to the person skilled in the art. For example, the fan could be of a different height or diameter. The base and the nozzle of the fan could be of a different depth, width and height. The fan need not be located on a desk, but could be free standing, wall mounted or ceiling mounted. The fan shape could be adapted to suit any kind of situation or location where a cooling flow of air is desired. A portable fan could have a smaller nozzle, say 5 cm in diameter. The means for creating an air flow through the nozzle can be a motor or other air emitting device, such as any air blower or vacuum source that can be used so that the fan assembly can create an air current in a room. Examples include a motor such as an AC induction motor or types of DC brushless motor, but may also comprise any suitable air movement or air transport device such as a pump or other means of providing directed fluid flow to generate and create an air flow. Features of a motor may include a diffuser or a secondary diffuser located downstream of the motor to recover some of the static pressure lost in the motor housing and through the motor.

The outlet of the mouth may be modified. The outlet of the mouth may be widened or narrowed to a variety of spacings to maximise air flow. The air flow emitted by the mouth may pass over a surface, such as Coanda surface, alternatively the airflow may be emitted through the mouth and be projected forward from the fan assembly without passing over an adjacent surface. The Coanda effect may be made to occur over a number of different surfaces, or a number of internal or external designs may be used in combination to achieve the flow and entrainment required.

Other shapes of nozzle are envisaged. For example, a nozzle comprising an oval, or 'racetrack' shape, a single strip or line, or block shape could be used. The fan assembly provides access to the central part of the fan as there are no blades. This means that additional features such as lighting or a clock or LCD display could be provided in the opening defined by the nozzle.

Other features could include a pivotable or tiltable base for ease of movement and adjustment of the position of the nozzle for the user.

The invention claimed is:

1. A bladeless fan assembly for creating an air current, the fan assembly comprising:

a nozzle;

a base;

a mixed flow impeller;

a motor for driving the mixed flow impeller to create an air flow through the nozzle, and a diffuser located downstream from the mixed flow impeller and at least partially surrounding a portion of the motor, wherein the nozzle is mounted on the base, wherein the base houses the mixed flow impeller, the nozzle comprising an interior passage for receiving the air flow from the base and a mouth through which the air flow is emitted, the nozzle extending substantially orthogonally about an axis to define an opening through which air from outside the bladeless fan assembly is drawn by the air flow emitted from the mouth, wherein the nozzle and the base each have a depth in the direction of said axis, and wherein the depth of the base is no more than twice the depth of the nozzle.

2. A fan assembly as claimed in claim 1, wherein the depth of the base is in the range of 100 mm to 200 mm.

3. A fan assembly as claimed in claim 1, wherein the depth of the base is about 150 mm.

4. The fan assembly of claim 1, wherein the mixed flow impeller surrounds a lower part of the motor.

5. The fan assembly of claim 1, wherein the diffuser at least partially surrounds an upper part of the motor.

6. The fan assembly of claim 1, wherein the diffuser comprises blades.

7. The fan assembly of claim 1, wherein the diffuser is configured to increase a static pressure of the air flow emitted from the mixed flow impeller.

8. The fan assembly of claim 1, wherein the impeller comprises blades mounted on a conical hub.

9. A fan assembly as claimed in claim 1, wherein the fan assembly has a height extending from an end of the base remote from the nozzle to an end of the nozzle remote from the base, and a width perpendicular to the height, both the height and the width being perpendicular to the said axis, and wherein the width of the base is no more than 75% the width of the nozzle.

10. A fan assembly as claimed in claim 9, wherein the motor comprises a DC brushless motor.

11. A bladeless fan assembly for creating an air current, the fan assembly comprising:

a nozzle;

a base;

a mixed flow impeller;

a motor for driving the mixed flow impeller to create an air flow through the nozzle, and a diffuser located downstream from the mixed flow impeller and at least partially surrounding a portion of the motor, wherein the nozzle is mounted on the base, wherein the base houses the mixed flow impeller, the nozzle comprising an interior passage for receiving the air flow from the base and a mouth through which the air flow is emitted, the nozzle extending substantially orthogonally about an axis to define an opening through which air from outside the bladeless fan assembly is drawn by the air flow emitted from the mouth, the fan assembly having a height extending from an end of the base remote from the nozzle to an end of the nozzle remote from the base, and a width perpendicular to the height, both the height and the width being perpendicular to the said axis, and wherein the width of the base is no more than 75% the width of the nozzle.

12. A fan assembly as claimed in claim 9 or 11, wherein the width of the base is in a range from 65% to 55% the width of the nozzle.

13. A fan assembly as claimed in claim 12, wherein the width of the base is around 50% the width of the nozzle.

14. A fan assembly as claimed in claim 9 or 11, wherein the height of the fan assembly is in the range 300 mm to 400 mm.

15. A fan assembly as claimed in claim 1 or 11, wherein the base is substantially cylindrical.

16. A fan assembly as claimed in claim 9 or 11, wherein the base has at least one air inlet, and wherein said at least one air inlet is arranged substantially orthogonal to said axis.

17. A fan assembly as claimed in claim 16, wherein the base has a side wall comprising said at least one air inlet.

18. A fan assembly as claimed in claim 16, wherein said at least one air inlet comprises a plurality of air inlets extending about a second axis substantially orthogonal to said axis.

19. A fan assembly as claimed in claim 16, comprising a flow path extending from each air inlet to an inlet to said mixed flow impeller, wherein the inlet to said mixed flow impeller is substantially orthogonal to each air inlet.

20. A fan assembly as claimed in claim 9 or 11, wherein the nozzle comprises a loop.

21. A fan assembly as claimed in claim 9 or 11, wherein the nozzle is substantially annular.

22. A fan assembly as claimed in claim 9 or 11, wherein the nozzle is at least partially circular.

23. A fan assembly as claimed in claim 9 or 11, wherein the interior passage is continuous.

24. A fan assembly as claimed in claim 9 or 11, wherein the interior passage is substantially annular.

25. A fan assembly as claimed in claim 9 or 11, wherein said motor is arranged to create the air flow through the nozzle having a pressure of at least 400 kPa.

26. A fan assembly as claimed in claim 9 or 11, wherein, in use, a mass flow rate of air projected therefrom is at least 450 l/s.

27. A fan assembly as claimed in claim 26, wherein the motor comprises a DC brushless motor.

28. A fan assembly as claimed in claim 26, wherein the mass flow of air is in a range from 600 l/s to 700 l/s.

29. A fan assembly as claimed in claim 9 or 11, wherein the height of the fan assembly is around 350 mm.

30. The fan assembly of claim 11, wherein the mixed flow impeller surrounds a lower part of the motor.

31. The fan assembly of claim 11, wherein the diffuser at least partially surrounds an upper part of the motor.

32. The fan assembly of claim 11, wherein the diffuser comprises blades.

33. The fan assembly of claim 11, wherein the diffuser is configured to increase a static pressure of the air flow emitted from the mixed flow impeller.

34. The fan assembly of claim 11, wherein the impeller comprises blades mounted on a conical hub.

* * * * *